US005096477A

United States Patent [19]

Shinoda et al.

[11] Patent Number: 5,096,477

[45] Date of Patent: Mar. 17, 1992

[54] CLEAN AIR ROOM FOR A SEMICONDUCTOR FACTORY

[75] Inventors: Shousuke Shinoda; Tetsuo Yamashita; Yukio Sugihara; Yoshihiro Matsumoto, all of Tateyama, Japan

[73] Assignee: Kabushiki Kaisha N.M.B. Semiconductor, Chiba, Japan

[21] Appl. No.: 555,647

[22] Filed: Jul. 23, 1990

[30] Foreign Application Priority Data

Apr. 5, 1990 [JP] Japan ..... 2-90570

[51] Int. Cl.[5] ..... F24F 7/06

[52] U.S. Cl. ..... 55/385.2; 55/472; 454/187; 454/228

[58] Field of Search ..... 55/385.1, 385.2, 467, 55/472, 97; 98/31.5, 34.6, 36, 31.6

[56] References Cited

U.S. PATENT DOCUMENTS

| | | | |
|---|---|---|---|
| 3,158,457 | 11/1964 | Whitfield | 55/385.2 X |
| 4,549,472 | 10/1985 | Endo et al. | 55/385.2 X |
| 4,693,175 | 9/1987 | Hashimoto | 55/385.2 X |
| 4,699,640 | 10/1987 | Suzuki et al. | 55/385.2 |
| 4,838,150 | 6/1989 | Suzuki et al. | 55/385.2 X |

*Primary Examiner*—Richard L. Chiesa

*Attorney, Agent, or Firm*—Oliff & Berridge

[57] ABSTRACT

A clean air room for a semiconductor factory includes a plurality of clean air boxes placed in side-by-side relation and each designed for its own processing step, an air conditioning equipment including a fresh-air regulator for controlling a supply of fresh-air to the clean air boxes, and fan filter units for supplying the air under pressure, the clean air boxes having clean air chambers of which environment is maintained to a predetermined degree of cleanliness in response to the fan filter units and defining an air circulating path extending through the clean air chambers, the clean air chambers including low clean air chambers and an ultra clean air chamber divided by common side walls of the clean air boxes, the low clean air chambers having operating zones and the ultra clean air chamber having a transfer robot therein, and semiconductor processors extending through the common side walls and having processing stations, the processing stations being located at least within the ultra clean air chamber. The ultra clean air chamber includes partitions between which the transfer robot is movable, and the partitions and the common side walls cooperate to form small chambers, the partitions having openings through which an arm of the robot is moved into and out of the small chambers.

4 Claims, 5 Drawing Sheets

CLEAN AIR ROOM FOR A SEMICONDUCTOR FACTORY

BACKGROUND OF THE INVENTION

1. Field of the Invention

The present invention generally relates to a clean air room for use in a semiconductor factory, which can maintain an ultra clean air environment.

2. Description of the Prior Art

In a semiconductor factory, a clean air room or ultra clean environment is required to improve the technique for manufacturing semiconductor devices such as large-scale or very large scale integration.

The provision of such a clean air room is also important in order to improve fully automated systems, automatic transfer systems or unmanned manufacturing lines.

A conventional clean air room typically includes a clean air chamber, the top wall of which has a laminar air flow system with special air filters (HEPA filter) and an air blower system for supplying pressurized air. The air is introduced into the clean air chamber through the air filters and then, circulated therein. The degree of cleanliness in a room is represented by the number of particles of dust or other impurities per one cubic feet, for example at Class 1, Class 100 or Class 1000. The smaller the number, the cleaner the room environment. Class is a function of atmospheric pressure, velocity and filtration capability.

FIG. 6 illustrates a conventional clean air room (U.S. Pat. No. 4,699,640).

The prior art clean air room includes three different sections, upper section 2, middle section and lower section 3. The middle section has two side walls 4, 4 and two hanging partitions 5, 5 having openings and cooperating with the side walls 4, 4 to form three clean zones or clean air chambers $R_1$, $R_2$ and $R_3$.

The chamber environment is maintained as follows. An air conditioning equipment 6, placed adjacent to the lower section 3, is active to draw air from the lower section 3 and feed the air under pressure to the upper section 2 through an external feed pipe 14. The air vertically flows from HEPA filters 8 mounted on a top wall 7 to vent holes 10 as shown by the arrow.

Each of the clean air chambers $R_1$ has a transfer robot 11 and a processing station 12*a* of a semiconductor manufacturing apparatus 12. Its degree of cleanliness is maintained at Class 100 or cleaner. The rest of each of the semiconductor manufacturing apparatus 12 extends through the opening of the hanging partition 5 and is located within the clean air chamber $R_2$. Its degree of cleanliness is maintained at Class 1000 or dirtier since wafers need not be exposed. The degree of cleanliness of the clean air chamber $R_3$, where an operator works, is on the order of lowest Class 10,000. The three clean air chambers share the air supply chamber or upper section 2 and the air returning chamber or lower section 3.

The hanging partition 5, made of plastic, is in the form of an antistatic plate and has a lower end located 20 to 30 m above the apparatus 12. The cleanliness of each zone varies depending upon the specifications and number of the HEPA filters 8 and how many times an hour each zone is ventilated.

Power cords, wires and pipes are all contained in the lower section 3 so as to effectively utilize the clean air room.

With the clean air room thus constructed, the cleanliness of the clean air chambers varies depending on operating conditions. This system consumes less energy, maintains cleaner air environment and is inexpensive to maintain.

A disadvantage with the prior art clean air room is that the direction of flow of air in the clean air chambers cannot be independently controlled. This is because a single large air conditioning equipment is used to provide a constant flow of air to the air supply chamber or the upper section of the clean air room. This type of air conditioning equipment requires a considerable amount of energy and suffers from mechanical failure. Such failure adversely affects the overall clean air room. Consequently, it is difficult to maintain the clean air room, particularly clean air chamber $R_1$, in a clean air condition for a long period of time.

Also, a fan of the air conditioning equipment is spaced away from the clean air chamber, and a long pipe must be used to supply air to the clean air chamber. This arrangement results in a decrease in the air pressure and thus, requires a larger air conditioning equipment.

SUMMARY OF THE INVENTION

Accordingly, it is an object of the present invention to provide a clean air room for a semiconductor factory, which can independently control the direction of flow of air in clean air chambers each designed for its own processing step so as to reduce the loss of air pressure, which provides an optimum environment in each clean air chamber with a constant air flow, regardless of other chambers' conditions and which is easy to maintain.

In order to achieve the foregoing objects, there is provided a clean air room for a semiconductor factory which comprises a plurality of clean air boxes placed in side-by-side relation and each designed for its own processing step, an air conditioning equipment including a fresh-air regulator for controlling a supply of fresh-air to said clean air boxes, and fan filter units for supplying the air under pressure, said clean air boxes having clean air chambers of which environment is maintained to a predetermined degree of cleanliness in response to said fan filter units and defining an air circulating path extending through said clean air chambers, said clean air chambers including low clean air chambers and an ultra clean air chamber divided by common side walls of said clean air boxes, said low clean air chambers having operating zones and said ultra clean air chamber having a transfer robot therein, and semiconductor processors extending through said common side walls and having processing stations,, said processing stations being located at least within said ultra clean air chamber.

The ultra clean air chamber includes partitions between which said transfer robot is movable, and said partitions and said common side walls cooperate to form small chambers, said partitions having openings through which an arm of said robot is moved into and out of said small chambers.

The air conditioning equipment is thus capable of independently controlling the clean air boxes. The cleanliness of each clean air chamber is determined by the specifications of the fan filter units in the clean air box and the flow of air through the fan filter units. In this way, any of the clean air chambers do not affect the others, and each maintained in an ultra clean air condition for a long period of time with the air circulating therein.

The air conditioning equipment is independently operated relative to the clean air boxes and can be easily maintained while other equipments are being operated.

An area or zone where semiconductor devices are processed are surrounded by the common side walls and partitions and maintained in an ultra clean air condition. The temperature and moisture in the small chambers are kept constant by air so as to provide an optimum processing environment.

BRIEF DESCRIPTION OF THE DRAWINGS

A better understanding of the invention may be had by reference to the following detailed description when taken in conjunction with the accompanying drawings, in which.

DETAILED DESCRIPTION OF THE PREFERRED EMBODIMENT

The present invention will now be described by way of example with reference to the drawings.

Figure 1:
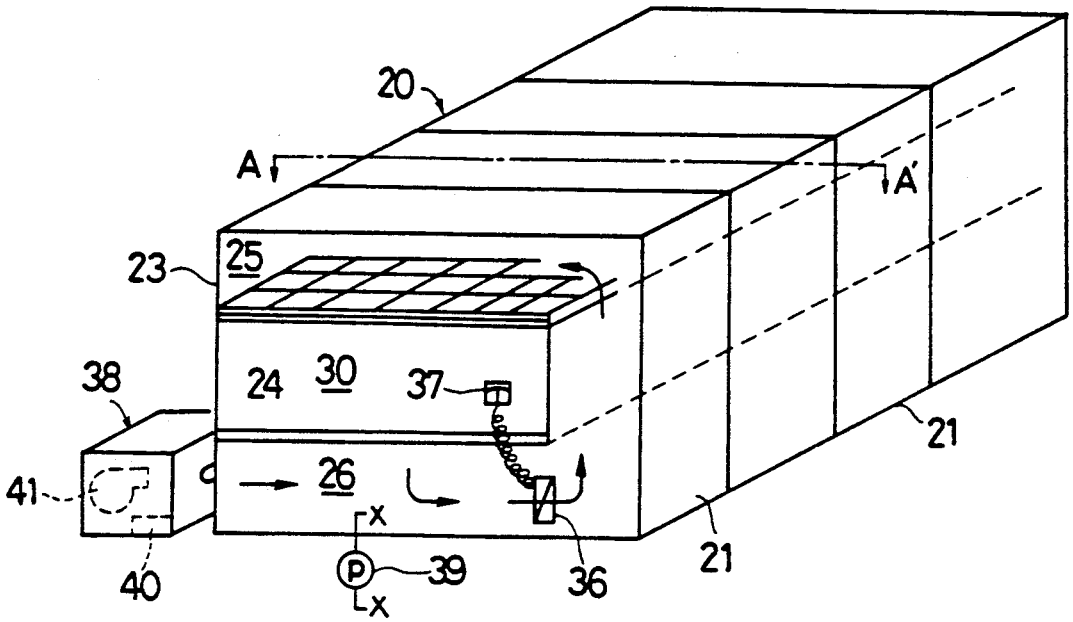
FIG. 1 is a perspective view of a clean air room for a semiconductor factory constructed according to the present invention.

With reference to FIG. 1, there is shown a clean air room 20 which generally includes a plurality of clean air boxes 21 placed in side-by-side relation and each designed for its own processing step, and a fresh-air regulator 38 for controlling a supply of fresh-air to each of the clean air boxes 21.

Figure 2:
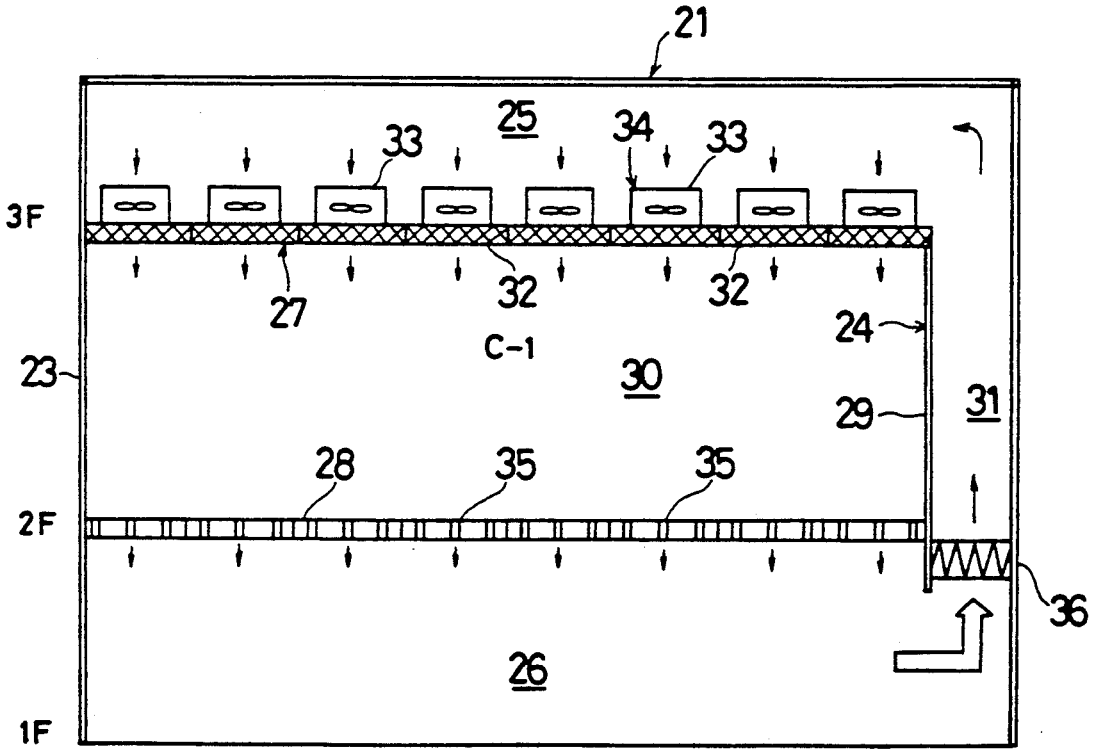
FIG. 2 is a side sectional view of a clean air box taken along the line A—A' of FIG. 1.

FIG. 2 is a side sectional view of the clean air box 21 taken along the line A—A' of FIG. 1, The clean air box 21 has a space defined by outer walls 23 and divided by an inner wall 24 into three different sections, an upper section 25, a middle section and a lower section 26.

The inner wall 24 has a top wall 27, a bottom wall 28 and a side wall 29. The middle section of the clean air box 21 has a clean air chamber 30 defined by these walls 27, 28 and 29 and another chamber 31 through which the upper section 25 and the lower section 26 are communicated with one another.

A plurality of fan filter units 34 are disposed in the top wall 27 an each includes a filter 32 and a fan 33 placed thereon. The bottom wall 28 has a plurality of vent holes 35. The chamber 31 has an air inlet in which a cooling coil 36 is disposed to cool an air flowing from the upper section 25 to the lower section 26 under the control of a controller 37 mounted within the clean air chamber 30, as shown in FIG. 1, so as to keep an appropriate temperature in the clean air chamber 30.

Figure 3:
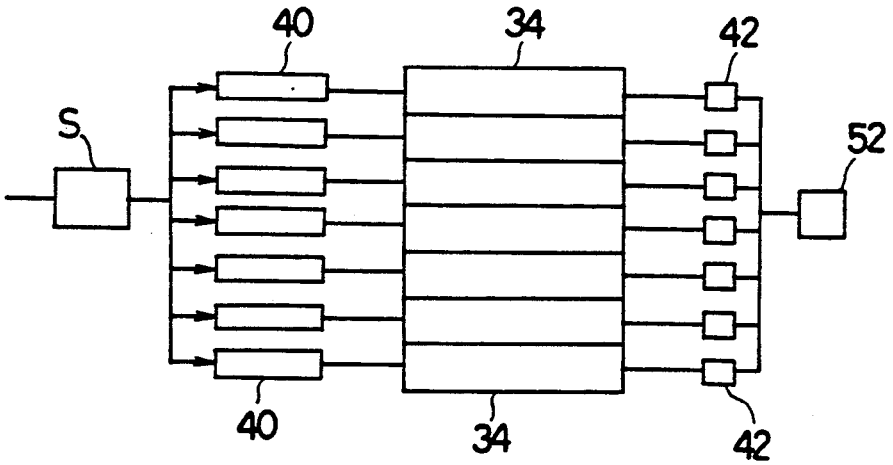
FIG. 3 is a block diagram of a system for controlling fan/filter units.

FIG. 3 is a block diagram of a central control system for controlling the fan filter units 34 so as to keep the clean air chamber 30 clean.

In the illustrated embodiment, an air conditioning equipment generally includes the fresh-air regulator 38 for supplying fresh-air to the lower section 26 of each of the clean boxes 21, the cooling coil 36 for maintaining temperature of circulating air constant, and invertors 40 for controlling a power source S for a fan 41 in response to air pressure in the lower section 26 sensed by a pressure sensor 39. The air conditioning equipment further includes the fan filter units 34, a remote controller 42 for remotely controlling the fan filter units 34, and a computer 52 for monitoring and controlling temperature, pressure, moisture and other factors.

With the air conditioning equipment thus constructed, the clean air boxes 21 can be independently controlled.

The lower sections 26 of the clean air boxes 21 are communicated with one another so as to provide a utility chamber to which the fresh-air is supplied by the fresh-air regulator 38. The fan filter units 34 are used to control the flow of the fresh-air.

The cooling coil 36 mounted at the lower section of each of the clean air boxes 21 and the pressure sensors disposed in a circulating path cooperate to more precisely control the flow of fresh-air through the fan filter units 34 and temperature in the clean air boxes 21.

In the illustrated embodiment, a single fresh-air regulator is used to supply fresh-air to the lower section 26 under the control of a computer. Alternatively, a small fresh-air regulator may be provided at the lower section of each box or externally of each box 21 so as to control the flow of fresh-air to the corresponding fan filter unit 34.

Figure 4:
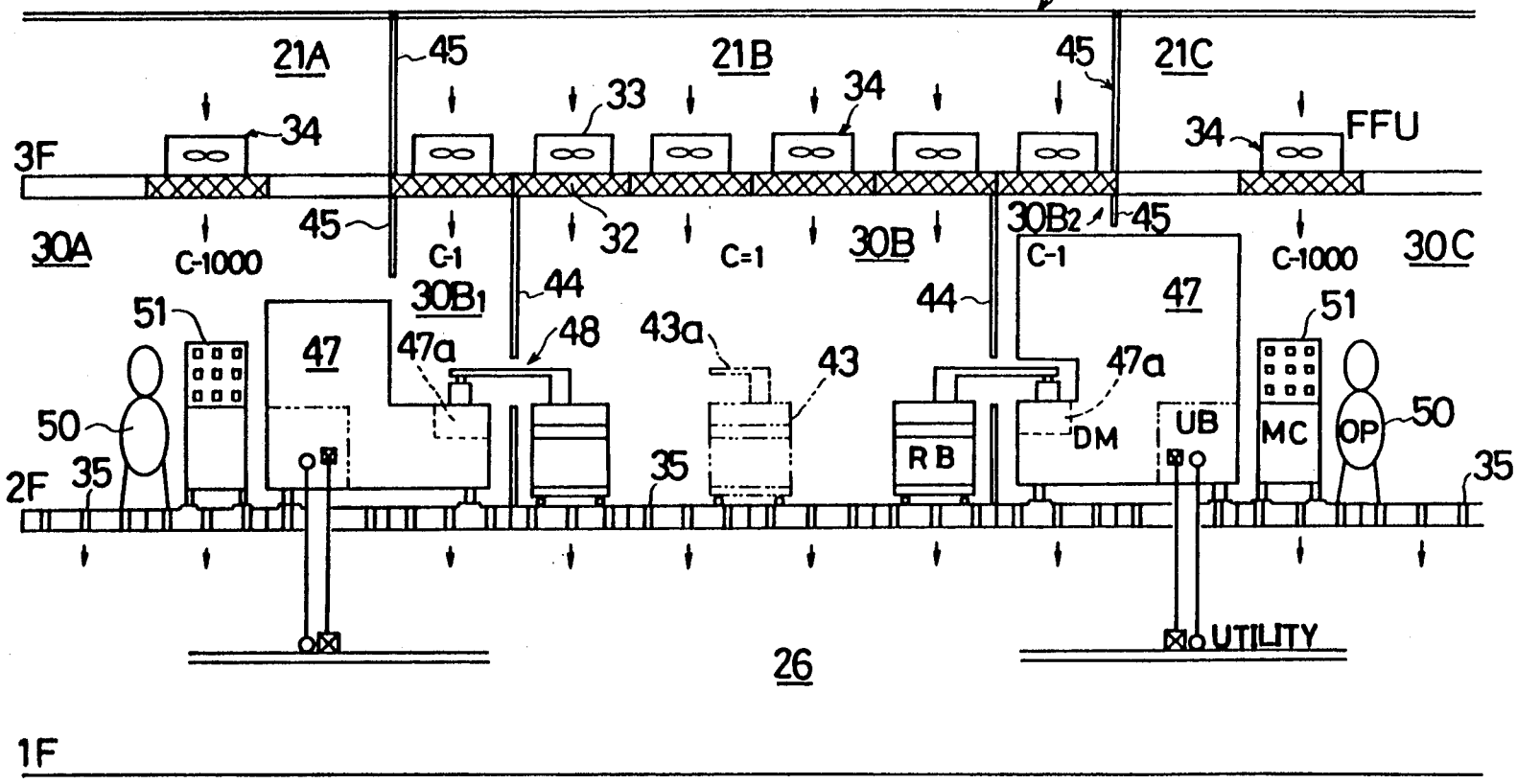
FIG. 4 is a side sectional view of the clean air boxes taken along the line extending at right angles to the line A—A' of FIG. 1.

FIG. 4 is a side sectional view taken along the line extending at right angles to the line A—A' of FIG. 1 showing the process for manufacturing semiconductors devices in the clean air room 20 of the present invention.

As shown in FIG. 4, clean air boxes 21A to 21C are assembled in side-by-side relation. Operators work in the clean air boxes 21A and 21C. A robot is movable in the clean air box 21B to process semiconductor devices. Each clean air chamber 30 (A, B and C) has the fan filter units 34 on the top wall 27 and the vent holes 35 in the bottom wall 28.

The clean air box 21B has an ultra clean air chamber 30B of which degree of cleanliness is maintained at Class 1. A robot 43 is used to transfer wafers in the ultra clean air chamber 30B. This robbot is not of a self-cleaning type and can be simple in structure since wafers are exposed during transfer.

The ultra clean air chamber 30 B has spaced apart partitions 44, 44 between which the transfer robot 43 is movable. Common side walls 45, 45 are used to divide the upper section 25 of the clean air room and separate the ultra clean air chamber 30B from low clean air chambers 30A and 30C. The partitions 44, 44 and the common side walls 45, 45 cooperate to form two small chambers $30B_1$ and $30B_2$. These small chambers $30B_1$ and $30B_2$ are as clean as the ultra clean air chamber 30B. In the small chambers $30B_1$ and $30B_2$, air flows in the same direction, and temperature and moisture are kept constant.

The common side wall 45 serves to separate the ultra clean air chamber 30B from the low clean air chamber 30A. Semiconductor processors 47, 47 have processing stations 47*a*, 47*a* located within the small chambers $30B_1$ and $30B_2$.

Each of the partitions 44, 44 has the openings 48 through which an arm 43*a* of the transfer robot 43 has access to the processing station 47*a* to transfer a carrier with wafers to and from the robot 43.

The operators 50 in the low clean air chambers 30A and 30C and carry out such an operation while watching monitors in controllers 51, 51. The degree of cleanliness in a zone where the operators are situated may be approximately at Class 1000 since wafers are never exposed therein.

Power cords for the processors and controllers, gas pipes and hydraulic and pneumatic lines are all received in the lower sections 26 so as to effectively utilize the clean air chambers.

Figure 5:
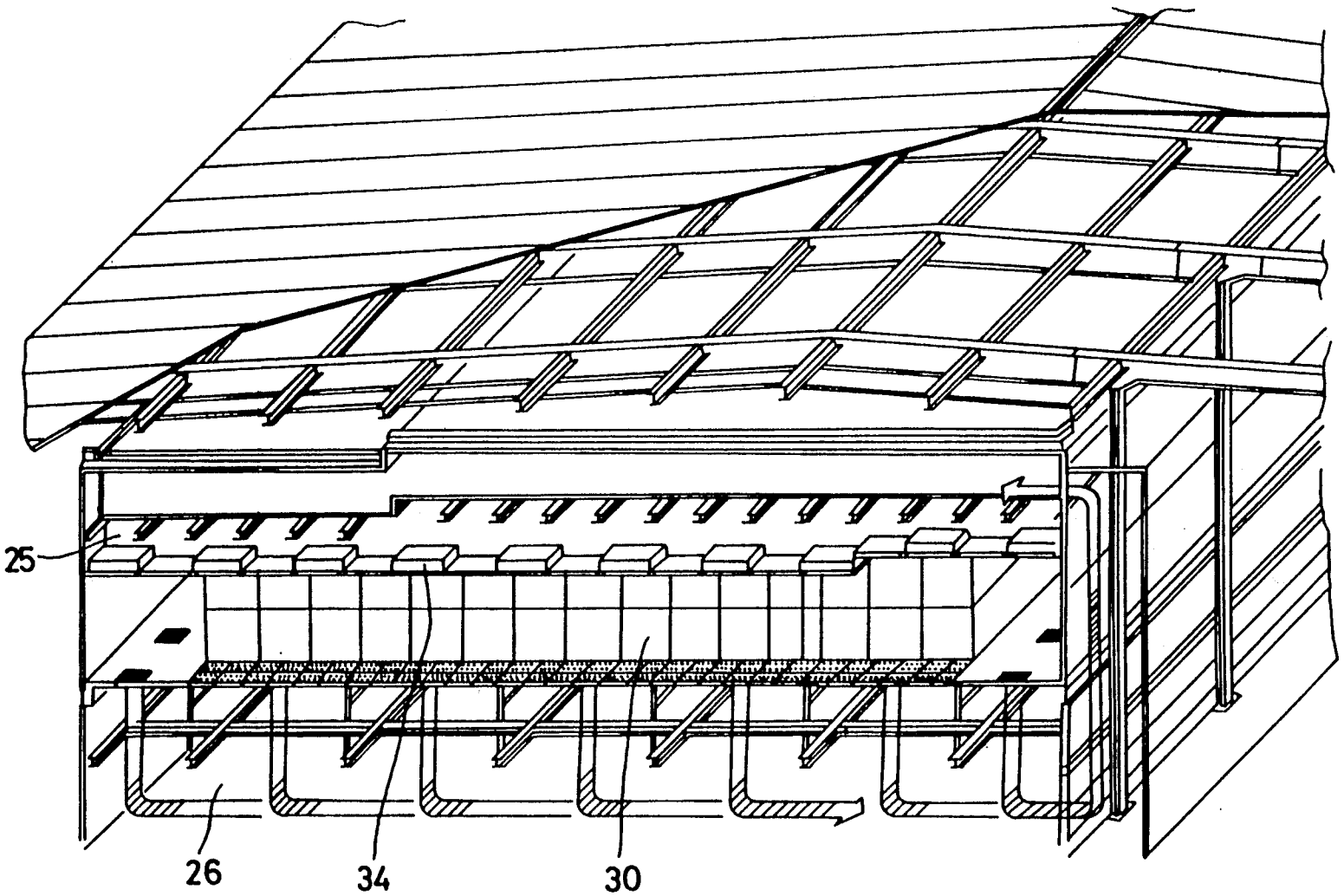
FIG. 5 is a fragmentary perspective view of the clean air room built in a factory site.
Figure 6:
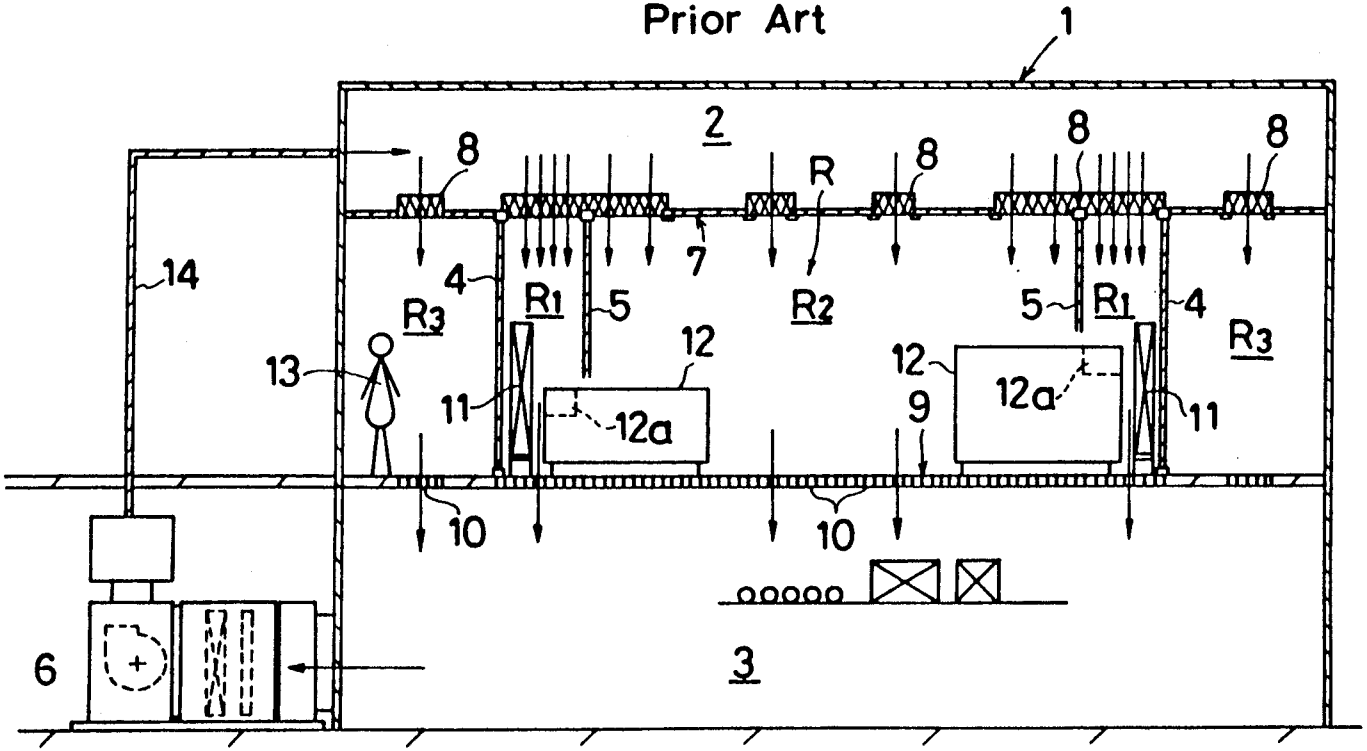
FIG. 6 Prior Art
FIG. 6 is a vertical sectional view of a conventional clean air room.

FIG. 5 is a fragmentary perspective view of the clean air room in the semiconductor factory. A multiplicity of blocks having identical structure are assembled to build up the clean air room.

Operation of the present invention is as follows:

With the clean air room thus constructed, the transfer robot 43 is moved in the ultra clean air chamber 30B along guide means by the operator. The robot 43 is active to transfer wafers to a clean or dust-free storage stocker or the semiconductor processors 47.

The operation of the robot 43 such as time and direction, and the arm 43*a* are automatically controlled by an upper computer.

The head of the transfer robot 43 is vertically and horizontally rotatable relative to its body. Upon movement of the head, the arm 43*a* of the robot 43 is moved into and out of the openings 48 of the partitions 44 while releasably gripping carriers with wafers contained therein. In this way, the carriers with the wafers can be transferred to and from the processing stations 47*a* of the processors 47 in the small chambers $30B_1$ and $30B_2$ or the clean storage stocker.

By moving the arm 43*a* of the robot 43 from the ultra clean air chamber 30B to the small chambers $30B_1$ and $30B_2$ in the same clean air box and vice versa, the steps for manufacturing semiconductor devices can be sequentially carried out.

The clean air room of the present invention has the following advantages.

The air conditioning equipment is composed of the fan filter units and separate cooling coil. The clean air room includes a plurality of clean air boxes placed in side-by-side relation. This arrangement is intended to simplify the direction of flow of air and control room temperatures according to various processing steps.

The ultra clean air chamber is maintained at Class 1 (0.1 μm). Its temperature is 24°±0.5° C., and the moisture is 45±2% which provides an improvement over a conventional chamber where temperature variation is ±1° C., and moisture variation is ±5%.

The fan filter units are in the form of a module. The fan filter units can be freely moved, and additional units may be added. With the total operating time of the fan filter units in mind, the environment of the clean air room can be easily changed to thereby save energy.

A supply of fresh-air from the fresh-air regulator is adjusted by the pressure sensor so as to keep air conditions constant when apparatus are transferred into the clean air room through doors. The absolute temperature of the fresh-air is kept constant so that moisture in the manufacturing zones can be also kept constant.

As stated above, various processing steps are carried out in the respective clean air boxes, the environment of which is independently controlled. This arrangement keeps the direction of flow of air in each clean air chamber constant and maintains the same in a desired clean air condition for a long period of time.

The clean air room is easy to control and maintain since the clean air boxes are exchangeable.

Finally, the common side walls and the partitions cooperate to form ultra clean air small chambers or processing zones between which the transfer robot is movable. These small chambers permit the air to flow in the same direction. As a result, the temperature and moisture in the small chambers can be more precisely controlled.

Although the preferred embodiment of the present invention has been described, it will be understood to one of ordinary skill in the art that various modifications and changes may be made therein without departing from the spirit of the invention and the scope of the appended claims.

What is claimed is:

1. A clean air room for a semiconductor factory comprising:

a plurality of clean air boxes formed by partitioning an upper section of a room with vertical walls, each placed in side-by-side relation and blocked of by a top wall and an inner wall, each clean air box being designed for its own processing step;

air conditioning equipment comprising a fresh air regulator for controlling a supply of fresh air to said clean air boxes, and a fan filter unit for controlling pressure and blowing air into each clean air box, wherein said fan filter unit is positioned below said upper section;

clean air chambers for providing laminar air flow into the clean air boxes, said clean air chambers being formed from said top wall and a bottom wall, in which a predetermined degree of cleanliness is maintained by means of fan filter units;

a passage provided outside of an inner wall through which air circulates by passing from a common lower section located under the bottom wall to the upper section of each clean air box which is divided by said inner wall;

said clean air chambers comprising low clean air chambers for accommodating operation zones and ultra clean air chambers for accommodating a transfer robot, divided by common side walls, semiconductor processing apparatus being disposed beneath said common sidewalls, wherein processing stations of said processing apparatuses are located at least partially in said ultra clean air chamber.

2. The clean air room of claim 1, further comprising partitions which divide the ultra clean chamber, said partitions and said common side walls defining small chambers, and said partitions containing openings through which an arm of said transfer robot may enter.

3. The clean air room of claim 1, wherein said laminar air flow is vertical.

4. The clean air room of claim 1, wherein the clean air room encompasses an entire interior space of a building.

* * * * *